US005289693A

United States Patent [19]

Major et al.

[11] Patent Number: 5,289,693

[45] Date of Patent: Mar. 1, 1994

[54] REFRIGERANT RECOVERY AND PURIFICATION APPARATUS WITH TELECOMMUNICATION MONITORING FACILITATION DEVICE

[76] Inventors: Thomas O. Major, 4105 Gray, Denver, Colo. 80212; Jack E. Major, Jr., 1590 Harlan, Lakewood, Colo. 80214

[21] Appl. No.: 7,211

[22] Filed: Jan. 22, 1993

[51] Int. Cl.[5] ..... F25B 45/00

[52] U.S. Cl. ..... 62/149; 62/292; 62/129

[58] Field of Search ..... 62/77, 85, 292, 149, 62/195, 475, 126, 127, 129; 379/39, 40, 51, 106, 107

[56] References Cited

U.S. PATENT DOCUMENTS 4,805,416 2/1989 Manz et al. ..... 62/292

5,187,942 2/1993 Komatsu et al. ..... 62/149

*Primary Examiner*—John M. Sollecito

*Attorney, Agent, or Firm*—J. Preston Oxenham

[57] ABSTRACT

A refrigerant recovery device is provided with a pressure sensing means, liquid sensing means, fluid flow measuring means, telephone dialer for dialing a telephone number, telephone signaler for transmitting a signal over a telephone line to a telephone communication device, and a controller for receiving a parameter value indicative signal indictive of pressure liquid or fluid flow in a predetermined range causing the telephone dialer to dial a telephone number and establish telephone communicaton with the telephone communicaton device and transmit a signal, indicative of pressure liquid or fluid flow, to the telephone communication device.

19 Claims, 3 Drawing Sheets

REFRIGERANT RECOVERY AND PURIFICATION APPARATUS WITH TELECOMMUNICATION MONITORING FACILITATION DEVICE

TECHNICAL FIELD

The present invention relates to apparatus for recovery of refrigerant charges contained in refrigerating systems. More particularly, the present invention relates to apparatus for recovering refrigerant from a refrigerating system prior to repair or replacement of the refrigerating system and purifying the charge for reuse in that or another system. Most particularly, the present invention related to monitoring the performance of such equipment while the equipment is recovering and purifying refrigerant from a refrigeration system.

BACKGROUND QF THE INVENTION

Traditionally, when refrigerant charged refrigeration systems were repaired, the refrigerant charge was simply loosed to the atmosphere as necessary to accomplish the repairs. Recently, it has become increasingly desirable to capture and reuse the refrigerant charges for a number of reasons; refrigerant pollution of the atmosphere is perceived as environmentally destructive, government regulations now limit the release of fluorocarbon refrigerants to the atmosphere, and the cost of refrigerant materials has increased making the disposal and replacement of the refrigerant charge increasingly costly.

Refrigerant recovery devices generally compress and cool refrigerant storage cansiters. Many of these systems have refrigerant storage canisters. Many of these systems have purification elements, such as filters, to remove contaminants from the used refrigerant during the removal-compression-cooling process.

Removal and purification of a refrigerant charge from a large refrigeration system can be a lengthily process. However, if the operator of recovery and purification apparatus of the present art leaves the apparatus unattended, a system failure may occur resulting in a shutdown of the recovery operation which will not be discovered until the operator returns. This will result in a longer overall time to complete the recovery operation than had been anticipated. This is of particular concern where time is of the essence in completing refrigeration system repairs, as when perishable commodities are at risk. Further, in such operations, should completion of the recovery operation occur more quickly than had been anticipated, the advantage of earlier completion will be lost.

DISCLOSURE OF THE INVENTION

It is an object of the present invention to provide a refrigerant recovery and purification apparatus which may be left unattended during refrigerant recovery and purification operations.

It is a further object of the present invention to provide a refrigerant recovery and purification apparatus which may be left unattended while in operation without risk of an unexpected, lengthily job delay.

It is yet another object of the present invention to allow one person to oversee a number of recovery and purification operations simultaneously.

It is an object of the present invention minimize total time required to complete a refrigeration equipment repair requiring removal of a refrigerant charge.

It is also an object of the present invention minimize total cost required to complete a refrigeration equipment repair requiring removal of a refrigerant charge.

A refrigerant recovery and purification apparatus comprising an embodiment of the present invention includes a compressor for compressing refrigerant and a first conduit for conducting refrigerant from a fluid circuit of the refrigeration unit to the compressor and provided with a coupler for coupling the conduit in fluid communication with a refrigeration unit fluid circuit. A second conduit for conducting refrigerant from a high pressure side of the compressor to a refrigerant storage vessel has a down stream end with a coupler for coupling in fluid communication with a refrigerant storage vessel. Pressure sensors are located in the first and second conduits and generate signals indicative of the pressure in the respective conduits.

The first conduit includes a phase separator for separating liquid refrigerant from gaseous refrigerant such that the liquid refrigerant can be gasified and recombined with the gaseous phase refrigerant to produce a substantially gaseous stream of refrigerant to the compressor. An alarm sensor is provided in the first conduit downstream of the separator and upstream of the compress and generates an alarm signal when the level of liquid refrigerant in the canister exceeds an acceptable level.

A preferred embodiment further includes a cumulative flow meter and a cumulative flow signaling device to signal when cumulative flow through the recovery device exceeds a predetermined cumulative flow.

An electronic controller receives the pressure signals and any alarm signal generated by the alarm sensor or signal generated by the flow meter device. Upon receiving a pressure signal from the first sensor indicative of a pressure lower than a predetermined pressure, the controller causes a telephone dialer to dial a telephone number and establish communication with a telephone communication device and generates a signal indicating the recovery process is completed. Upon receiving a pressure signal from the second sensor indicative of a pressure higher than a predetermined pressure, the controller causes a telephone dialer to dial a telephone number and establish communication with a telephone communication device and generates a signal indicating the occurrence of such high pressure. Upon receipt of an alarm signal or signal from the metering device, the controller similarly communicates the occurrence over a phone line. The signals sent over the telephone line may include data signals to a modem; sound signals, including voice messages, to a telephone or recording device; dialing tone signals to a paging device; or fax signals to produce a printed message. The controller and dialing device may be releasibly connected to the sensors and recovery apparatus. In another embodiment, the controller, dialing device, flow meter and cumulative flow signaling device may be assembled in a flow signaling unit, and the flow signaling unit releasibly connected to the recovery apparatus.

Other objects, advantages and aspects of the invention will become apparent upon reading of the following detailed description and claims and upon reference to the accompanying drawings.

DETAILED DESCRIPTION OF THE INVENTION

Figure 1:
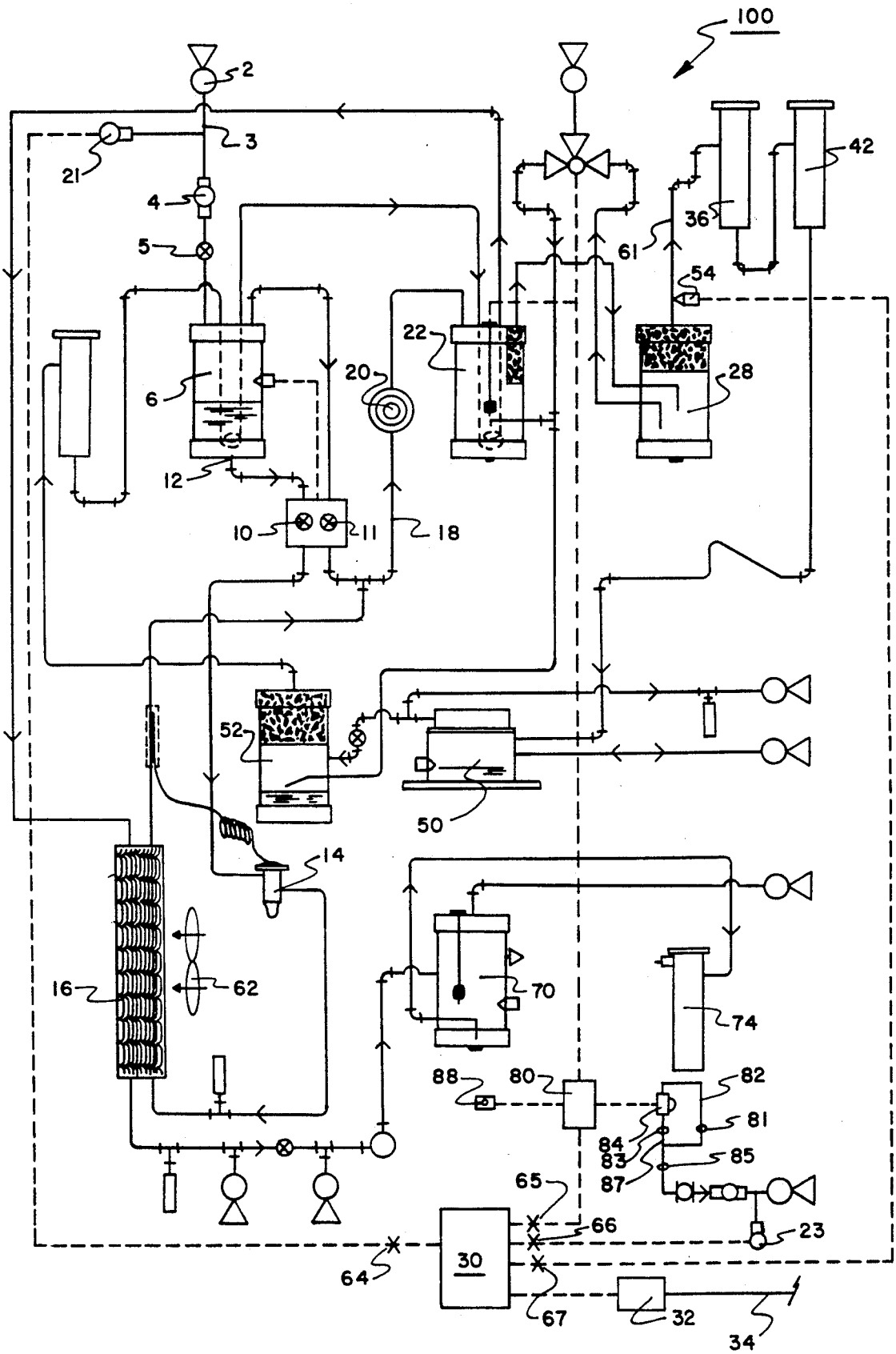
FIG. 1 is a schematic drawing of refrigerant recovery and purification apparatus comprising a preferred embodiment of the present invention.

Refrigerant purification and recovery apparatus 100 comprising an exemplary preferred embodiment of the present invention is shown schematically in FIG. 1. When refrigerant purification and recovery apparatus 100 is in use, inlet 2 is connected in fluid communication with the fluid circuit of a refrigeration unit from which the refrigerant is to be removed by utilizing a fluid conduit, such as a suction hose, adapted for connection to a connector provided on the refrigeration unit, generally near the suction side of the refrigerant unit compressor. When the recovery-purification process is begun by opening an outlet valve on the refrigeration unit and providing power to compressor 50 of recovery-purification apparatus 100, refrigerant is drawn from the refrigeration unit through inlet 2, conduit 3, particulate filter 4, solenoid valve 5 and into phase separator vessel 6.

Flow of refrigerant from separator vessel 6 is controlled by solenoid valves 10 and 11 in accordance with signals generated by liquid level sensor 8, which may be, for example, a float type sensor or a photoelectric sensor. Normally, when a presence of liquid refrigerant is detected by sensor 8, valve 10 is in an open position while valve 11 is closed, such that liquid refrigerant flows from separator vessel 6 through lower outlet 12 and valve 10, is throttled through temperature expansion valve 14, and flows through an evaporator core of condenser-evaporator 16 to be warmed by heat exchange with the ambient atmosphere such that the flow becomes substantially of gaseous phase before it is introduced into conduit 18.

When a presence of liquid refrigerant is not detected by sensor 8, valve 10 is placed in a closed position while valve 11 is placed in an open position, such that gaseous refrigerant flows from separator vessel 6 through upper outlet 13 and valve 11 into conduit 18. Gas phase refrigerant flows from conduit 18, through compressor pressure regulator valve 20, first stage oil removal element 22, second stage oil removal element 28, first oil polisher 36, vapor acid filter 42 and conduit 43 to compressor 50.

After compression by compressor 50, the hot, compressed refrigerant gas flows through hot-gas oil trap 52 and oil polisher 58. The hot, gaseous refrigerant then flows through conduit 60, including a coil portion within oil removal element 22 over which heat transfer occurs to cool the hot flowing gas and warm accumulated oil within canister 25, and through a condenser core of evaporator-condenser 16, where the refrigerant is further cooled by heat transfer to the ambient atmosphere. Cooling of the refrigerant gas in the condenser core of evaporator-condenser 16 is augmented by fan 62.

After cooling in the condenser core, the refrigerant flows to receiver-separator vessel 72 for purging of noncompressible gas contaminates as is described in detail in U.S. Pat. No. 5,078,756. From receiver-separator vessel 72, the refrigerant, now substantially in liquid phase, flows through liquid moisture filter 74 and particulate filter 76 to outlet 78, which is connected to a refrigerant storage vessel.

Exemplary refrigerant purification and recovery apparatus 100 comprising a preferred embodiment of the present invention includes pressure sensor 21 which senses the pressure of refrigerant flowing in conduit 3 just downstream of inlet 2 and transmits an electrical signal indicative of the pressure to electronic controller 30. When electronic controller 30 receives a signal from sensor 21 which is indicative of a pressure less than a predetermined pressure, indicating that the refrigerant recovery operation is complete, controller 30 causes dialer-signalling device 32 to dial a programmed telephone number and establish a telephone connection over telephone line 34 with a remote telephone communication device. Once communication is established, controller 30 causes dialer-signalling device 32 to transmit a signal over telephone line 34 to the remote telephone communication device indicating that the recovery operation is complete.

Exemplary refrigerant purification and recovery apparatus 100 also includes pressure sensor 23 which senses the pressure of refrigerant flowing in conduit 63 just upstream of outlet 78 and transmits an electrical signal indicative of the pressure to electronic controller 30. When electronic controller 30 receives a signal from sensor 23 which is indicative of a pressure higher than a predetermined pressure, indicating that the a refrigerant storage vessel to which outlet 78 is connected is full, controller 30 causes dialer-signalling device 32 to dial a programmed telephone number and establish a telephone connection over telephone line 34 with a remote telephone communication device. Once communication is established, controller 30 causes dialer-signalling device 32 to transmit a signal over telephone line 34 to the remote telephone communication device indicating that a new storage vessel must be provided to continue the recovery operation.

Liquid sensor 54 of exemplary refrigerant purification and recovery apparatus 100, which may be, for example, a photoelectric sensor, is positioned in conduit 61, between second stage oil removal element 28 and oil polisher 36, upstream of compressor 50. Should any liquid, such as liquid refrigerant, water or oil which may damage oil polisher 36 or compressor 50, flow past sensor 54 in conduit 61, liquid sensor 54 will generate an alarm signal indicative of the presence of liquid. When electronic controller 30 receives a signal from sensor 54 which is indicative of the presence of liquid, controller 30 causes dialer-signalling device 32 to dial a programmed telephone number and establish a telephone connection over telephone line 34 with a remote telephone communication device. Once communication is established, controller 30 causes dialer-signalling device 32 to transmit a signal over telephone line 34 to the remote telephone communication device indicating that a liquid flow alarm signal has been generated by liquid sensor 54.

Refrigerant recovery and purification apparatus 100 comprising the exemplary preferred embodiment also includes a signal device for indicating when a predetermined amount of refrigerant, which may be indicative of a need to change filter cores or of an expected completion of a recovery operation, has flowed through purification apparatus 100. During operation of recovery and purification apparatus 100, control board 80 receives a signal from flow meter 84 indicative of the flow of refrigerant through the purification course.

When cumulative flow of refrigerant through the purification course reaches a predetermined amount, control board 80 generates a signal indicating that the predetermined cumulative flow amount has been reached.

Flow meter 84 of purification apparatus 100 is provided with slip bypass conduit 82 and downstream orifice 87 to protect flow meter 84 from high differential pressures. Those familiar with the art will understand that orifice 87, located downstream of the junction of the downstream end of by pass conduit 82 and meter conduit 87, is sized to limit overall flow through the purification channel in expected high pressure conditions to a level at which meter 84 will properly function. Orifices 81 and 82, located within bypass conduit 82 and meter conduit 87 respectively, are sized and proportioned to allow flow of refrigerant through bypass 82 during the presence of high pressure differentials over meter 84 to extend the range of operation of meter 84 and avoid failure or improper operation of meter 84 over an expected range of operation.

Those familiar with the art will recognize that refrigerant purification and recovery apparatus 100 may include other sensing devices to sense additional operating parameters of apparatus 100 and transmit signals indicative of those parameters to controller 30. For example, a differential pressure sensor may be arranged to sense the pressure drop over particulate filter 4, which, when sufficiently high, may indicate plugging of filter 4 by impurities removed from recovered refrigerant, and transmit a signal indicative of the differential pressure to controller 30. A sensor for sensing the oil level in compressor 50 may be arranged to transmit signals to controller 30 indicative of the oil level in compressor 50. Controller 30 could then be programmed to transmit an alarm should filter 4 become plugged, excess oil accumulate in compressor 50, or the level of oil in compressor 50 become too low. Of course, these sensor signals may also be utilized to shut-down operation of recovery apparatus 100.

Dialer-signaling device 32 of exemplary refrigerant purification and recovery apparatus 100 may comprise any of a number of signaling devices well known in the computer and telephone arts. For example, where the remote telephone communication device is a modem, dialer-signaling device 32 may comprise a modem and transmit data signals to the remote modem such that the data may be displayed on a computer or other data reading device or cause an alarm signal to be generated. Where the remote telephone communication device is a fax machine, dialer-signaling device 32 may comprise a fax/modem and transmit a fax type message to the remote fax machine indicating that a particular operational parameter of refrigerant purification and recovery apparatus 100 is outside acceptable limits. Controller 30 may also include a clock device and cause dialer-signaling device 32 to transmit data signals representing operational parameters of refrigerant purification and recovery apparatus 100 to a remote telephone communication device comprising a modem at periodic intervals or at preprogrammed times. Where the remote telephone communication device comprises a modem, signaling device 32 may also be arranged to answer an incoming call from the remote modem and transmit data in response to demands by the remote communication device.

Where the remote telephone communication device is a telephone or voice recording answering machine, dialer-signaling device 32 may simply generate a tone coded to represent particular alarm situations or, dialer-signaling device 32 may include a tape or digital voice device and transmit an appropriate voice message to the remote communication device. Where a pager with a visual display is called, dialing-signaling device 32 may generate touch-tone type signals to cause a numerical code to appear on the display.

Releasible connectors may be provided at 64, 65, 66 and 67 to allow removal of dialing-signaling device 32 and controller 30 from the recovery apparatus and permit the use of a single dialing-signaling device and controller with more than one recovery machine as needed.

Figure 2:
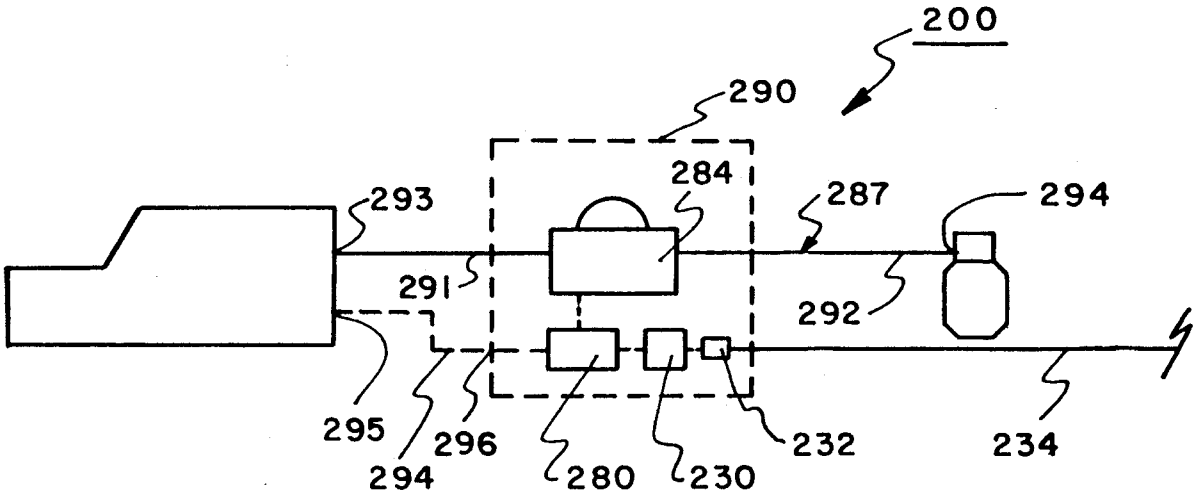
FIG. 2 is a schematic drawing of refrigerant recovery and purification apparatus comprising an alternative embodiment of the present invention.

Refrigerant purification and recovery apparatus 200 comprising an alternative embodiment of the present invention is shown in FIG. 2. In the embodiment of FIG. 2, flow meter 284, control board 280, controller 230 and dialer-signal device 288 are mounted in cabinet 290, represented by the dashed line box. Conduit 287 includes flexible pressure hose portions 291 and 292 and is provided with a releasible connector at 293 and a refrigerant storage vessel connector at 294. In addition to receiving signals generated by flow meter 284, control board 280 may also receive signals from other sensors through electrical cable 294, which is releasibly connected at 295 and 296. Cabinet 290 may also include an input device, such as a small keyboard, to input information, such as a predetermined cumulative flow amount, to control board 280. Cabinet 290 may also contain other sensor devices, such as a pressure sensor for sensing a pressure in conduit 287 to detect when a refrigerant canister is full.

Figure 3:
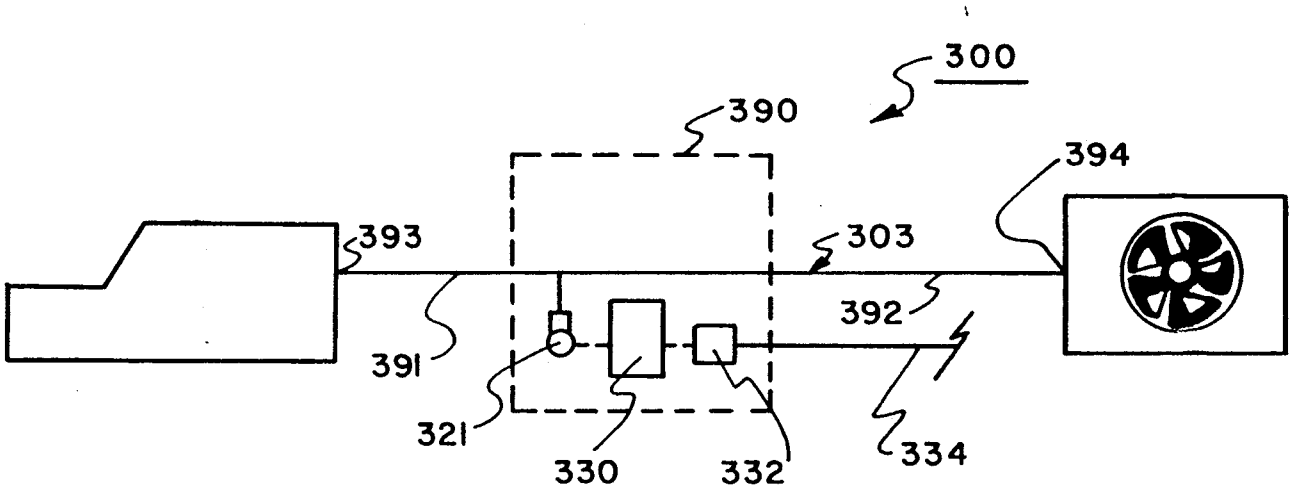
FIG. 3 is a schematic drawing of refrigerant recovery and purification apparatus comprising a second alternative embodiment of the present invention.

Refrigerant purification and recovery apparatus 300 comprising a second alternative embodiment of the present invention is shown in FIG. 3. In the embodiment of FIG. 3, pressure sensor 321, controller 330 and dialer-signal device 388 are mounted in cabinet 390, represented by the dashed line box. Conduit 303 includes flexible pressure hose portions 291 and 292 and is provided with a releasible connector at 293 and a coupler adapted to couple in fluid communication with the fluid circuit of a refrigeration system at 394. Cabinet 390 may also include an input device, such as a small keyboard, to input information, such as a predetermined pressure representative of recovery completion, to controller 330.

While exemplary refrigerant purification and recovery apparatus comprising a preferred embodiment of the present invention has been shown, it will be understood, of course, that the invention is not limited to that embodiment. Modification may be made by those skilled in the art, particularly in light of the foregoing teachings. It is, therefore, contemplated by the appended claims to cover any such modification which incorporates the essential features of this invention or which encompasses the spirit and scope of the invention.

We claim:

1. A refrigerant recovery apparatus for recovering refrigerant from a refrigeration unit comprising: means for controlling said recovery of refrigerant including:

parameter sensing means for sensing a value of a parameter indicative of operation of the apparatus and generating a signal indicative of the parameter value;

telephone dialer means for dialing a telephone number and establishing a telephone connection with a telephone communication device responding to the number dialed;

telephone signaling means for transmitting a signal over a telephone line to a telephone communication device; and, controller means for receiving said parameter value indicative signal and, when said signal is indicative of a parameter value in a predetermined range, causing said telephone dialer to dial a telephone number and establish telephone communication with a telephone communication device and, upon establishment of such communication, causing said telephone signaling device to transmit a signal to the telephone communication device.

2. An apparatus for recovering refrigerant from a refrigeration unit as in claim 1, further comprising:

compressor means for compressing refrigerant;

first conduit means for conducting refrigerant from a fluid circuit of the refrigeration unit to said compressor means, said first conduit means having an upstream end and a downstream end, said first conduit upstream end including coupling means for coupling said first conduit in fluid communication with the refrigeration unit fluid circuit, said first conduit downstream end connected to a suction side of said compressor means;

second conduit means for conducting fluid from a high pressure side of said compressor means to a refrigerant storage vessel, said second conduit means having an upstream end and a downstream end, said second conduit means upstream end attached to said compressor means and said second conduit means downstream end including coupling means for coupling said second conduit in fluid communication with a refrigerant storage vessel; and, said parameter value sensing means includes pressure sensing means for sensing a pressure of fluid within said first conduit means and generating a signal indicative of the pressure.

3. An apparatus for recovering refrigerant from a refrigeration unit as in claim 2, further comprising:

the parameter is a pressure and the parameter value range is a pressure less than a predetermined pressure.

4. An apparatus for recovering refrigerant from a refrigeration unit as in claim 1, further comprising:

compressor means for compressing refrigerant;

first conduit means for conducting refrigerant from a fluid circuit of the refrigeration unit to said compressor means, said first conduit means having an upstream end and a downstream end, said first conduit upstream end including coupling means for coupling said first conduit in fluid communication with the refrigeration unit fluid circuit, said first conduit downstream end connected to a suction side of said compressor means;

second conduit means for conducting fluid from a high pressure side of said compressor means to a refrigerant storage vessel, said second conduit means having an upstream end and a downstream end, said second conduit means upstream end attached to said compressor means and said second conduit means downstream end including coupling means for coupling said second conduit in fluid communication with a refrigerant storage vessel; and, said parameter value sensing means includes pressure sensing means for sensing a pressure of fluid within said second conduit means and generating a signal indicative of the pressure.

5. An apparatus for recovering refrigerant from a refrigeration unit as in claim 2, further comprising:

the parameter is a pressure and the parameter value range is a pressure greater than a predetermined pressure.

6. An apparatus for recovering refrigerant from a refrigeration unit as in claim 2, further comprising:

refrigerant phase separation means for dividing a stream of fluid refrigerant into a stream of liquid phase refrigerant and a stream of gaseous phase refrigerant, said phase separation means including a vessel for containing fluid refrigerant and having an upper end portion and a lower end portion, separator liquid refrigerant sensing means for sensing a presence of liquid phase refrigerant in a central portion of said vessel lying between an upper outlet and a lower outlet of said canister and generating a liquid phase indicative signal indicative of such presence; and, said parameter value sensing means includes alarm liquid refrigerant sensing means for sensing a presence of liquid phase refrigerant in a portion of said vessel lying between said upper outlet and said separator liquid refrigerant sensing means and generating an alarm signal indicative of such presence.

7. An apparatus for recovering refrigerant from a refrigeration unit as in claim 6, further comprising:

the parameter is a level of liquid phase refrigerant in said vessel and the parameter value range is a level higher than said alarm liquid refrigerant sensing means.

8. An apparatus for recovering refrigerant from a refrigeration unit as in claim 1 in which said telephone signaling means is a modem.

9. An apparatus for recovering refrigerant from a refrigeration unit as in claim 1 in which said telephone signaling means is a fax/modem.

10. An apparatus for recovering refrigerant from a refrigeration unit as in claim 1 in which said telephone signaling means transmits a tone generating signal.

11. An apparatus for recovering refrigerant from a refrigeration unit as in claim 1 in which said telephone signaling means transmits a voice generating signal.

12. A refrigerant recovery apparatus for recovering refrigerant from a refrigeration unit comprising: means for controlling said recovery of refrigerant including:

parameter sensing means for sensing a value of a parameter indicative of operation of the apparatus and generating a signal indicative of the parameter value;

telephone answering means for responding to a ring signal on a telephone line and establishing a telephone connection with a telephone communication device over the line;

telephone signaling means for transmitting a signal over a telephone line to a telephone communication device; and, controller means for receiving said parameter value indicative signal and causing said telephone signaling means to transmit a signal to the telephone communication device indicative of the parameter value.

13. An apparatus for recovering refrigerant from a refrigeration unit as in claim 12 comprising a plurality of parameter sensing means for sensing a value of a unique parameter indicative of operation of the apparatus and generating a signal indicative of the unique parameter.

14. An apparatus for recovering refrigerant from a refrigeration unit as in claim 13 in which said controller means receives each of the unique parameter value signals and causes said telephone signaling means to transmit a signal indicative of a sequence of unique parameter values.

15. An apparatus for recovering refrigerant from a refrigeration unit as in claim 13 in which said controller means receives each of the unique parameter value signals and causes said telephone signaling means to transmit a signal indicative of a unique parameter value in response to an inquiry signal of a telephone communication device.

16. An apparatus for recovering refrigerant from a refrigeration unit comprising:

compressor means for compressing refrigerant;

first conduit means for conducting refrigerant from a fluid circuit of the refrigeration unit to said compressor means, said first conduit means having an upstream end and a downstream end, said first conduit upstream end including coupling means for coupling said first conduit in fluid communication with the refrigeration unit fluid circuit, said first conduit downstream end connected to a suction side of said compressor means;

second conduit means for conducting fluid from a high pressure side of said compressor means to a refrigerant storage vessel, said second conduit means having an upstream end and a downstream end, said second conduit means upstream end attached to said compressor means and said second conduit means downstream end including coupling means for coupling said second conduit in fluid communication with a refrigerant storage vessel;

pressure sensing means for sensing a pressure of fluid within said first conduit means and generating a signal indicative of the pressure;

telephone dialer means for dialing a telephone number and establishing a telephone connection with a telephone communication device responding to the number dialed;

telephone signaling means for transmitting a signal over a telephone line to a telephone communication device; and, controller means for receiving said pressure indicative signal and, when said signal is indicative of a pressure less than a predetermined pressure, causing said telephone dialer to dial a telephone number and establish telephone communication with a telephone communication device and, upon establishment of such communication, causing said telephone signaling device to transmit a signal to the telephone communication device.

17. An apparatus for recovering refrigerant from a refrigeration unit comprising:

compressor means for compressing refrigerant;

first conduit means for conducting refrigerant from a fluid circuit of the refrigeration unit to said compressor means, said first conduit means having an upstream end and a downstream end, said first conduit upstream end including coupling means for coupling said first conduit in fluid communication with the refrigeration unit fluid circuit, said first conduit downstream end connected to a suction side of said compressor means;

second conduit means for conducting fluid from a high pressure side of said compressor means to a refrigerant storage vessel, said second conduit means having an upstream end and a downstream end, said second conduit means upstream end attached to said compressor means and said second conduit means downstream end including coupling means for coupling said second conduit in fluid communication with a refrigerant storage vessel;

pressure sensing means for sensing a pressure of fluid within said second conduit means and generating a signal indicative of the pressure;

telephone dialer means for dialing a telephone number and establishing a telephone connection with a telephone communication device responding to the number dialed;

telephone signaling means for transmitting a signal over a telephone line to a telephone communication device; and, controller means for receiving said pressure indicative signal and, when said signal is indicative of a pressure greater than a predetermined pressure, causing said telephone dialer to dial a telephone number and establish telephone communication with a telephone communication device and, upon establishment of such communication, causing said telephone signaling device to transmit a signal to the telephone communication device.

18. A refrigerant recovery apparatus for removing refrigerant from a refrigeration unit comprising:

a fluid channel with an upstream end adapted to be coupled in fluid communication with a fluid circuit of a refrigeration system and a downstream end in fluid communication with a compressor;

liquid sensing means for sensing a presence of a liquid in said fluid channel and generating an alarm signal indicative of such presence;

telephone dialer means for dialing a telephone number and establishing a telephone connection with a telephone communication device responding to the number dialed;

telephone signaling means for transmitting a signal over a telephone line to a telephone communication device; and, controller means for receiving said alarm signal and, upon receiving said signal, causing said telephone dialer to dial a telephone number and establish telephone communication with a telephone communication device and, upon establishment of such communication, causing said telephone signaling device to transmit a signal to the telephone communication device.

19. A refrigerant recovery apparatus for removing refrigerant from a refrigeration unit, the apparatus including a fluid channel with an upstream end having a coupler for coupling the channel in fluid communication with a fluid circuit of the refrigeration unit, a downstream end having a coupler for coupling the channel in fluid communication with a refrigerant storage vessel, comprising:

fluid flow measuring means for measuring a cumulative amount of fluid flowing through the channel;

signaling means for generating a cumulative flow signal;

control means for causing said signaling means to generate said signal once said measuring means has measured a cumulative flow amount equal to a predetermined cumulative flow amount;

telephone dialer means for dialing a telephone number and establishing a telephone connection with a telephone communication device responding to the number dialed;

telephone signaling means for transmitting a signal over a telephone line to a telephone communication device; and, controller means for receiving said cumulative flow signal and, upon receipt of said signal, causing said telephone dialer to dial a telephone number and establish telephone communication with a telephone communication device and, upon establishment of such communication, causing said telephone signaling device to transmit a signal to the telephone communication device.

* * * * *